United States Patent [19]

Tarrant et al.

[11] 4,222,188

[45] Sep. 16, 1980

[54] COMBINED MERCHANDISE DISPLAY, SOUND REPRODUCTION DEVICE AND INSIGNIA SUPPORTING UNIT

[76] Inventors: Fred A. Tarrant, 9661 Skylark Blvd., Garden Grove, Calif. 92641; James S. Parsons, 12 Silverbit La., Rolling Hills Estates, Calif. 90274

[21] Appl. No.: 944,775

[22] Filed: Sep. 22, 1978

[51] Int. Cl.[3] ..... G09F 1/12

[52] U.S. Cl. ..... 40/152.1; 40/902; 40/906; 40/455

[58] Field of Search ..... 40/107, 455, 124.1, 40/45.5, 158 R, 152.1; 46/34, 175 AR, 175 R

[56] References Cited

U.S. PATENT DOCUMENTS

| | | | |
|---|---|---|---|
| 2,440,062 | 4/1948 | Allen | 40/107 X |
| 3,273,894 | 9/1966 | Clawson | 46/34 X |
| 3,691,312 | 9/1972 | Petersen | 40/455 |
| 3,798,806 | 3/1974 | Sanford | 40/455 |
| 3,857,191 | 12/1974 | Sadorus | 40/455 |
| 4,102,067 | 7/1978 | Tarrant | 40/455 |

*Primary Examiner*—Gene Mancene

*Assistant Examiner*—Wenceslao J. Contreras

*Attorney, Agent, or Firm*—William C. Babcock

[57] ABSTRACT

A combined sound reproducing device for either music or speech, together with a display for an opaque sheet on which an insignia is defined that may be a work of art, photograph, printed material or the like, and the display being a part of a resonator box that not only amplifies the volume of the sound reproducing device, but the resonator box having a number of spaced recesses defined in the upper portion thereof in which merchandise such as cosmetics or the like may be mounted in an attractive manner to encourage the sale thereof. The sound reproducing device may be either a spring actuated music box or a power driven unit in which a cassette may be removably disposed to have a voice message or music reproduced therefrom. The invention above-defined is particularly adapted for gift purposes, as the recipient not only receives selected merchandise, but also a suitable message or music, as well as an appropriate insignia displayed thereon such as a photograph, work of art, or printed material, which insignia is supported on the invention by a picture frame.

10 Claims, 8 Drawing Figures

COMBINED MERCHANDISE DISPLAY, SOUND REPRODUCTION DEVICE AND INSIGNIA SUPPORTING UNIT

BACKGROUND OF THE INVENTION

1. Field of the Invention

Combined Merchandise Display, Sound Reproduction Device, and Insignia Supporting Unit.

2. Description of the Prior Art

On many occasions it is desirable to do more for a person than merely send the person a greeting card congratulating him on a particular occassion, hoping for an early recovery from an illness or the like. This desire normally expressed by forwarding the person an inexpensive gift that normally be sent separate and apart from the greeting card. The selection of an inexpensive gift is troublesome and time-consuming as is the preparation of the gift for shipment.

The primary purpose of the present invention is to provide a unit particularly adapted for gift purposes, which unit is a combined sound reproducing device for either music, speech, or the like, together with a display for an opaque sheet on which an insignia is defined that may be a work of art, photograph, or printed material such as a message hoping for an early recovery or congratulations, and the display being a part of a resonator box that not only amplifies the sound of the reproduction device, but the resonator box having a number of spaced recesses defined therein in which merchandise such as cosmetics or the like that are suitable for gifts may be mounted in an attractive manner.

Another object of the invention is to supply an invention of the character above-described in which the major components thereof may be inexpensively injected-molded from a polymerized resin and one in which each of the components serves to provide a number of functions.

CROSS-REFERENCE TO RELATED APPLICATION

The present application is an improvement on the subject matter disclosed and claimed in application Ser. No. 730,266 that was filed Oct. 6, 1976 entitled "Combined Greeting Card and Music Box Structure".

SUMMARY OF THE INVENTION

The combined merchandise display, sound reproduction device, and insignia supporting unit includes a power-actuated sound reproducing device of generally rectangular shape that has first and second oppositely disposed side surfaces, and first means projecting outwardly from the first side surface that may be moved from a first position to a second position to initiate operation of the device, and the first means when moved from the second position to the first position terminating operation of the sound reproducing device.

A resonator box is provided that is preferably rectangular in shape and includes a back wall, a front wall laterally spaced from the back wall, and a continuous side wall that extends between the back wall and front wall. The resonator box is preferably formed from a resilient polymerized resin. The resonator box has the sound reproducing device situated at a fixed position within the interior thereof, and a portion of the first means projecting through an opening in the front wall of the box to permit the sound reproducing device to operate as desired by a user thereof.

A cover is hingedly supported from the box, and is capable of being selectively pivoted to a first position to overlie the front wall, or to a second position where the front wall is exposed. The front wall preferably has a number of spaced recesses therein in which pieces of merchandise may be removably disposed and the pieces of merchandise being removably held within the recess when the cover is in the first position. The merchandise will normally be of a type suitable for gifts. The cover is preferably transparent in order that the merchandise situated in the recesses may be viewed when the cover is in the first position.

A lock is supported from the cover that removably engages an opening or the like in the front wall to removably hold the cover in the first position. An insignia bearing sheet of substantially the same size as the cover is provided that overlies the latter when the cover is in the first position, with the sheet preferably being opaque, and the insignia that is viewable on the forward space of the sheet being a work of art, photograph, printed material such as a verse, or a message hoping for an early recovery, or congratulations or the like.

A hollow rectangular frame is provided that is capable of removably engaging the cover when the insignia bearing sheet overlies the forward exposed side surface of the cover, with the insignia bearing sheet being gripped between the cover and frame, and the major portion of the insignia on the sheet being visible through the hollow frame. The cover serves a dual function of removably maintaining the merchandise within the previously identified recesses when the cover is in the first position, and the cover in cooperation with the frame serving as a mounting for the insignia bearing sheet. The rearward wall of the resonator box has a support pivotally mounted thereon, which permits the assembly to be disposed in an upwardly extending position on a horizontal surface, to permit the insignia to be viewed. The major portions of the invention above described are preferably formed or molded from a polymerized resin, to permit the inventions to be produced in volume by injection molding and the like, and due to the low cost of production, they may be retailed at a relatively low price to encourage the widespread use thereof both in the retailing of merchandise such as cosmetics or the like or for gift purposes.

DESCRIPTION OF THE PREFERRED EMBODIMENT

Figure 1:
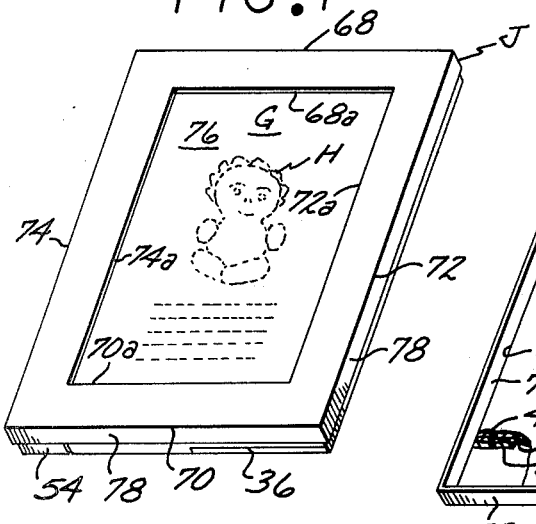
FIG. 1 is a perspective view of the invention in which the cover is in a first position, with an insignia bearing sheet overlying the cover, and a first form of frame removably secured to the cover to maintain the insignia bearing sheet in a fixed position thereon.
Figure 2:
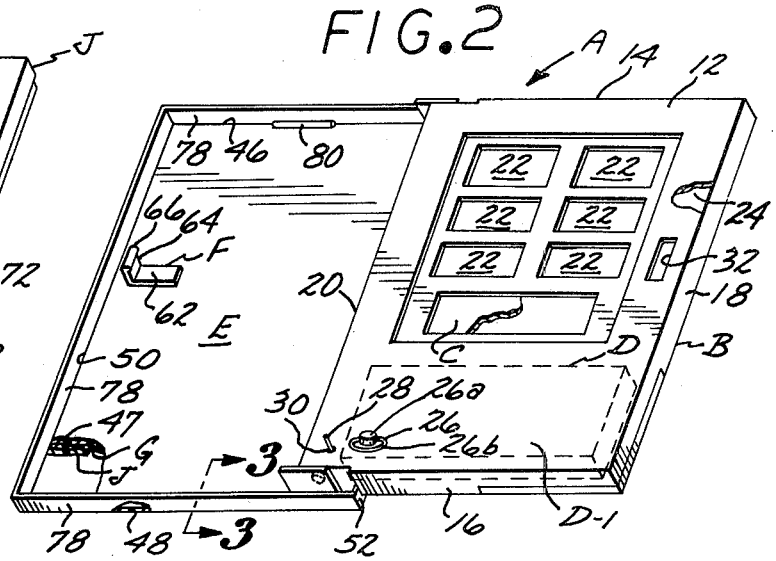
FIG. 2 is a perspective view of the invention as shown in FIG. 1, but with the cover having been pivoted to a second position to expose the recesses formed on the front wall of the container, as well as the merchandise situated within the recesses.
Figure 3:
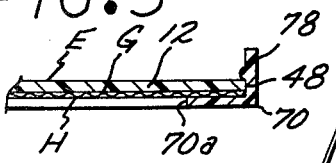
FIG. 3 is a transverse fragmentary view of a portion of the cover, the insignia bearing sheet, and the frame.

The combined merchandise display, sound reproduction device and insignia supporting unit A as may best be seen in FIGS. 1, 2 and 3 includes a resonator box B that is preferably rectangular in shape and formed from a resilient polymerized resin. The box B includes a rectangular back wall 10, a similarly shaped front wall 12, a first end wall 14 and second end wall 16. The resonator box B also includes a first side wall 18 and second side wall 20. The forward exposed surface of the front wall 12 as may be seen in FIG. 2, has a number of longitudinally and laterally spaced recesses 22 extending downwardly therein, with the recesses capable of removably supporting merchandise C such as cosmetic units, perfume, or the like, which merchandise will normally be of the type suitable for gift purposes. The resonator box B has an interior confined space 24 that is of sufficient depth as to permit a sound reproducing device referred to generally by the letter D to be disposed therein. In the form of the invention as shown in FIG. 2 a spring actuated music box D-1 is provided, which has a handle 26 projecting therefrom to wind the same. The handle 26 is of the type that includes a stem 26*a* that is operationally connected to the music box D-1 with the stem pivotally supported a crescent shaped handle 26*b* that is adapted when not in use to lie flat against the exposed surface of the front piece 12 as shown in FIG. 2.

The music box D-1 is actuated by a spring-loaded pin 28 that projects upwardly through an opening 30 in the front wall 12, and when in a first position as shown in FIG. 2 maintains the music box D-1 in an inoperative condition. A spring-loaded pin 28 is operatively associated with the music box D-1 and projects outwardly through the first opening 30 in the front wall 12. The pin 28 when in a first position as shown in FIG. 2 results in actuation of a music box D-1. However, when the pin 28 is moved downwardly to a second position operation of the music box D-1 is terminated. A second opening 32 is formed in the front wall 12, the purpose of which will later be explained.

Figure 8:
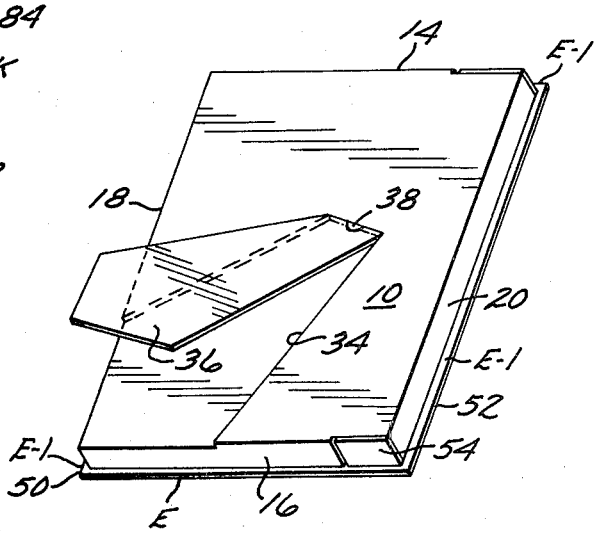
FIG. 8 is a rear perspective view of the invention shown in FIG. 1.

The back wall 10 as may be seen in FIGS. 2 and 8 has an elongate recess 34 defined therein, which recess extends upwardly from the lower left-hand corner of the back wall 10 as viewed in FIG. 8, and is of such dimensions and aonfiguration as to accommodate a support 36, which support is connected to the back wall 10 by a pivotal connection 38. By pivoting the support 36 outwardly as shown in FIG. 8, and tilting the invention A to an upright position, the invention may be supported in either a horizontal or vertical upwardly extending position from a horizontal surface (not shown).

Figure 4:
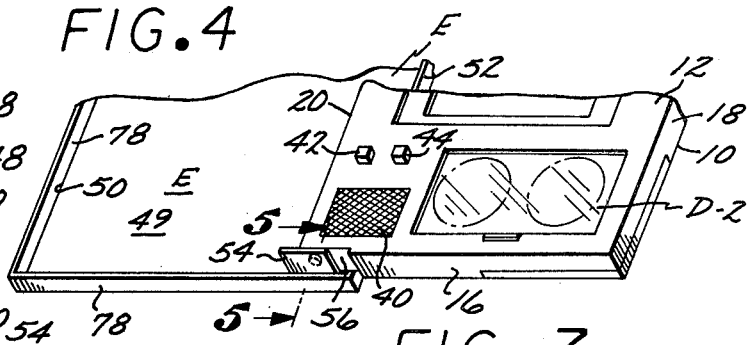
FIG. 4 is a perspective view of the invention that is similar to the view shown in FIG. 2, but with the resonator box having a power-driven sound reproduction unit situated within the interior thereof that alternatively accepts either a continuous loop or a cassette or the like, a loud speaker mounted in the front wall of the resonator box, and switch means that automatically actuate the sound reproduction unit when the frame is pivoted to an open position.

In FIG. 4 is will be seen that the resonator box B has a second form of sound reproducing device D-2 therein. The sound reproduction unit D-2 is a flat, substantially rectangular power-driven device of a conventional nature that is commercially available that is adapted to accept a cassette, or built in continuous loop tape transport mechanism and the second form of power reproduction unit D-2 having a minature loud speaker associated therewith, which minature loud speaker 40 is mounted in the lower left-hand corner of the front wall 12 as shown in FIG. 4. The second form of sound reproduction unit D-2 has a first button 42 operatively associated therewith that controls a normally open switch that is closed when the frame is pivoted to an open position, and in the latter position completes an electric circuit to actuate the sound reproduction unit.

Figure 5:
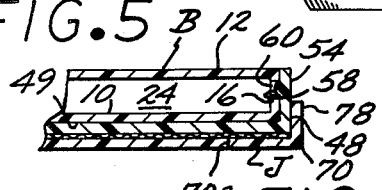
FIG. 5 is a fragmentary transverse cross-sectional view of the invention taken on the line 5—5 of FIG. 4, illustrating the manner in which the cover is pivotally supported from the resonator box, as well as the manner in which the first form of frame is removably supported from the cover.
Figure 7:
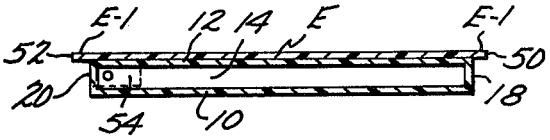
FIG. 7 is a transverse cross-sectional view of the invention shown in FIG. 6 taken on the line 7—7 thereof.
Figure 6:
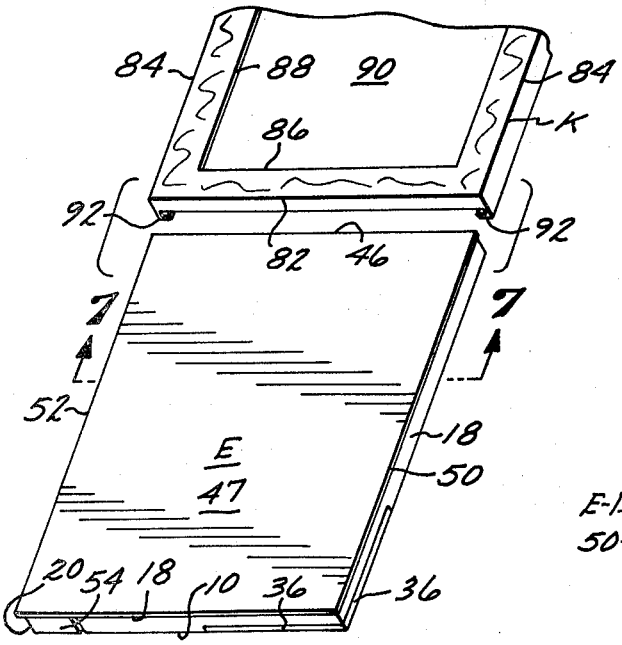
FIG. 6 is an exploded perspective view illustrating the resonator box with the cover occupying a first position thereon, and a second form of hollow frame being disposed above the box and adapted to removably engage side edges of the cover to occupy a fixed position thereon, when a stop (not shown) on the second form of the frame engages an end edge of the cover.

A rectangular cover E is provided that is preferably formed from a transparent sheet of polymerized resin. The cover E has first and second end edges 46 and 48 and first and second side edges 50 and 52 respectively as may be seen in FIG. 2. The cover E as may be seen in FIGS. 4 and 6 has an exterior side surface 47 and interior side surface 49. A pair of axially aligned tabs 54 extend outwardly from the interior side surface 49 of the cover E adjacent the second side edge 52 thereof as shown in FIGS. 4 and 5 with the pair of tabs 54 being inset slightly from the first and second end edges 46 and 48 of the cover E and located adjacent the second side edge 52 thereof. The pair of tabs 54 are disposed in a pair of recesses 56 formed in the first and second end walls 14 and 16 of the resonator box B, which recesses are located adjacent the second side wall 20 thereof. The pair of tabs 56 have a pair of axially aligned protuberances projecting therefrom and towards one another, which protuberances are pivotally supported in a pair of axially aligned openings 60 formed in the first and second end walls 14 and 16 of the resonator box B adjacent the second side wall 20 thereof. The top E is of slightly greater width and length than the front wall 12, and as a result when the cover is in the position shown in FIG. 7 and overlying the front wall 12, marginal edge portions E-1 of the cover project outwardly beyond the first and second end walls 14 and 16 and first and second side walls 18 and 20 of the resonator box B as may be seen in FIGS. 7 and 8. The cover E as may best be seen in FIG. 2 on the interior side surface 49 thereof supports a fastener F, which fastener is of L-shape cross-section and includes a first leg 62 bonded to the side surface 49 and transversely aligned with the opening 32, and the first leg having a second leg 64 extending outwardly from one end thereof, which leg on the free end portion thereof supports a lug 66 that is adapted to removably engage a side edge of the second opening 32 to hold the cover E in an overlying position on the front wall 12. When the cover E is disposed to overlie the front wall 12 and may removably lock thereto by the fastener F, the merchandise C disposed in the recesses 22 as clearly visible, but is prevented from falling out of the recesses by the cover should the invention A be inadvertently turned into an upside-down position. When the cover E is in a first position overlying the front wall 14, the pin 28 is moved to the second position to prevent actuation of the first form of sound reproduction device D-1, with this device being actuated when the cover is moved to the second position shown in FIG. 2.

An opaque rectangular shaped sheet G is provided that is of substantially the same size as the cover E, and is adapted to be disposed in abutting contact with the exterior side surface 47 thereof. The sheet G as shown in FIG. 1 has an insignia H depicted on the exterior surface thereof, which insignia may be a work of art, drawing, photograh, or printed material such as a verse of a congratulatory nature or the like. The sheet G may be removably supported on the cover E by either a first open rectangular frame J of the structure shown in FIGS. 1 and 3, or a second frame K that serves the same purpose but is of the structure illustrated in FIG. 6. The first open rectangular frame J as may be seen in FIG. 1 is preferably formed from a polymerized resin and is preferably of a contrasting color to that of the sheet G. The first open frame J includes first and second exterior end edges 68 and 70, and first and second exterior side edges 72 and 74. The frame also includes first and second interior end edges 68*a* and 70*a*, and interior side edges 72*a* and 74*a*. The interior end edges 68*a* and 70*a* and interior side edges 72*a* and 74*a* cooperate to provide an opening 76 through which the insignia H is viewed when the frame is removably mounted on the cover E. A continuous relatively thin rim 78 projects outwardly from the first and second exterior end edges 68 and 70 and the first and second exterior side edges 72 and 74 as best seen in FIGS. 1, 2 and 3. The interior dimensions of the continuous rim 78 are such that it slidably engages the first and second edges 46 and 48 and first and second side edges 50 and 52 of the cover E as shown in FIGS. 1 and 2. The interior end surfaces of the rim 78 adjacent the end surfaces 46 and 48 of the cover E have a pair of longitudinally aligned lugs 80 projecting inwardly therefrom that resiliently engage the interior end surfaces of the cover E as shown in FIG. 2, and can be snapped into engagement or out of engagement with the cover E due to the resiliency of the material defining the continuous rim 78. When the first frame J is so mounted on the cover E, it serves to grip the marginal edge portions of the sheet G, and removably hold the sheet G in a position on the cover where the insignia H may be viewed through the opening 76.

The second open rectangular frame K serves the same function as the first open frame J. Second frame K includes a pair of first exterior end edges 82 and pair of exterior side edges 84. A pair of first interior end edges 86 and pair of first interior side edges 88 cooperate to define a marginal rectangular edge portion therebetween, with the end edges 86 and side edges 88 cooperating to define an opening 90 as may best be seen in FIG. 6. The pair of exterior side edges 84 have two longitudinally extending members 92 of L-shaped transverse cross-section extending downwardly therefrom, which L-shaped members serve to slidably engage the projecting portions E-1 adjacent the first and second side edges 50 and 52 of the cover E as may be seen in FIG. 6. A stop (not shown) is formed on the end edge 82 that occupies an upper position when the invention A is being supported upright on a horizontal surface by the support 36. Prior to the second open frame K being removably mounted on the cover E, the sheet G is mounted on the cover and is held in position thereon by the frame K in the same manner as the sheet is held in position by the first frame J.

The use and operation of the invention A is extremely simple. The cover E is first placed in the second position as shown in FIG. 2 and desired pieces of merchandise C are placed in the recesses 22. The handle 26 is now used to wind the first form D-1 of the sound reproduction unit. The cover E is now pivoted to a first position to overlie the front wall 12, and is removably held in this position by the fastener F engaging the second opening 32. When the cover E is pivoted to the first position above-described, it contacts the actuating pin 28 to move it to a second position to prevent operation of the sound reproduction unit B-1. The sheet G is now overlaid onto the exterior side surface 47 of the cover E, and the first open frame J is now snapped into position onto the cover E, with the frame and cover gripping the sheet G therebetween, and the insignia H being visible through the opening 76. The same procedure is followed when the second form K of the frame is used, with the sheet G overlying the surface 47 of the cover E, and the second form of frame K being slid into engagement with the cover rather than being snapped into place thereon.

The use and operation of the invention has been explained previously in detail and need not be repeated.

What is claimed is:

1. A combined sound reproduction, merchandise display and support for an insignia bearing sheet assembly, said assembly including:

a. a dimensionally stable resonator box that is formed from a resilient sheet material that has a back wall, front wall and a continuous side wall that extends therebetween, said front wall having at least one first recess extending downwardly therein toward said back wall, said front wall, backwall and side wall cooperating to define a confined space therebetween, and said recess capable of having said merchandise removably disposed therein;

b. a sound reproduction device situated within said confined space, and said resonator box serving to amplify the sound from said sound reproduction device when the latter is actuated;

c. first means for actuating said sound reproduction device from the exterior of said resonator box;

d. a flat cover that in a first position overlies said front wall, said cover having marginal edge portions that project outwardly from said cover, said cover when in said first position preventing said merchandise being displaced from said first recess;

e. hinge means that pivotally support said cover from said resonator box and allow said cover to be pivoted to a second position where access may be had to said merchandise in said first recess;

f. second means for removably locking said cover to said resonator box when said cover is in said first position;

g. a flat insignia bearing sheet that overlies said cover and is of substantially the same size and configuration as the latter and is supported in a flat position on said cover;

h. a hollow frame that overlies said insignia bearing sheet, said hollow frame defining an opening therein of such transverse cross-section that at least the major portion of said insignia is visible therethrough; and i. third means for removably holding said hollow frame on said cover to grip said insignia bearing sheet between it and said cover, with said cover serving the functions of preventing inadvertent displacement of said merchandise from said recess when said cover is in said first position and as support for said insignia bearing sheet when the latter is removably held on said cover by said frame.

2. An assembly as defined in claim 1 which in addition includes:

j. support means pivotally secured to said back wall that may be moved from a first position substantially parallel to said back wall to a second outwardly extending position, with said support means cooperating with the portion of said resonator box most adjacent thereto to support said resonator box in an upright position from a flat horizontal surface.

3. An assembly as defined in claim 1 in which said sound reproduction device is a spring-actuated music box, said music box including a spring-loaded actuating pin that projects outwardly through a first opening in said cover, said pin being contacted by said cover when the latter is in a first position and said pin forced to a first position where said music box is inoperative, and said pin moving to a second position where said music box is operative when said cover is pivoted to said second position.

4. An assembly as defined in claim 1 in which said sound reproduction device includes:

j. a source of electric power;

k. a continuous electrically driven loop transport unit;

l. a loud speaker; and m. an electric circuit that connects said source of electricity continuous loop transport unit, loud speaker, and said circuit including normally open spring-loaded switch means that automatically close when said cover is moved to an open position.

5. An assembly as defined in claim 1 in which said frame is formed from a resilient material and said third means are a pair of engaging members located on opposite sides of said opening in said frame that removably engages said marginal edge portions of said cover.

6. An assembly as defined in claim 1 in which said frame has a pair of parallel side edges, and said third means is a pair of members of transverse L-shaped cross-section that extend longitudinally, said side edges slidably engage said marginal edge portions, and said frame further including a stop to prevent said frame sliding from said cover.

7. An assembly as defined in claim 1 in which said cover is transparent.

8. An assembly as defined in claim 1 in which said fastening means is an engaging member on said cover that removably engages a second opening in said front wall.

9. An assembly as defined in claim 1 in which said front wall has a plurality of first longitudinally and transversely spaced recesses, each of which recesses is capable of holding a piece of merchandise.

10. An assembly as defined in claim 1 in which said resonator box is rectangular in shape and has first and second side walls and a pair of end walls, said end walls having a pair of second recesses therein adjacent said second side wall, said second recesses having axially aligned openings therein and said hinge means being a pair of longitudinally aligned tabs that extend outwardly from said cover and disposed in said second recesses, and said tabs including axially aligned protuberances that project towards one another and pivotally engage said openings in said recesses.

* * * * *